US007431279B2

(12) United States Patent
Budelsky et al.

(10) Patent No.: US 7,431,279 B2
(45) Date of Patent: Oct. 7, 2008

(54) MEDIA SUPPORT FOR AN IMAGING APPARATUS

(76) Inventors: Stephen A. Budelsky, 3344 Drayton Pl., Lexington, KY (US) 40503; David W. DeVore, 3032 Woodfield, Richmond, KY (US) 40475

( * ) Notice: Subject to any disclaimer, the term of this patent is extended or adjusted under 35 U.S.C. 154(b) by 438 days.

(21) Appl. No.: 11/171,943

(22) Filed: Jun. 30, 2005

(65) Prior Publication Data

US 2007/0002116 A1 Jan. 4, 2007

(51) Int. Cl.
*B65H 85/00* (2006.01)
*B41J 2/01* (2006.01)

(52) U.S. Cl. ..... 271/3.14; 347/104

(58) Field of Classification Search ..... 347/104; 271/65, 171, 145, 162, 3.14; 400/691, 605, 400/599.1

See application file for complete search history.

(56) References Cited

U.S. PATENT DOCUMENTS 5,082,269 A * 1/1992 Hirayama et al. ..... 271/65
5,387,043 A * 2/1995 Fujioka et al. ..... 400/691
5,454,555 A 10/1995 Kiyohara et al.
5,464,205 A 11/1995 Bang
5,494,364 A * 2/1996 Murakami et al. ..... 400/599.1
5,746,528 A 5/1998 Mayer et al.
5,975,520 A * 11/1999 Shim ..... 271/171
6,070,868 A * 6/2000 Nagato et al. ..... 271/145
6,340,256 B1 1/2002 McKay et al.
6,382,617 B1 5/2002 Yen et al.
6,390,701 B2 5/2002 Osmus
6,419,410 B1 7/2002 Osmus et al.
6,474,884 B2 11/2002 Chiu
6,595,514 B2 7/2003 Takahashi
6,729,616 B2 5/2004 Chen
6,830,401 B1 12/2004 Hwang et al.
6,848,685 B2 2/2005 Katsuyama
2002/0054780 A1 * 5/2002 Chiu ..... 400/605
2006/0163798 A1 * 7/2006 Wong et al. ..... 271/162

* cited by examiner

*Primary Examiner*—Stephen D. Meier
*Assistant Examiner*—Carlos A Martinez, Jr.

(57) ABSTRACT

An imaging apparatus includes a housing, and a media support mounted to the housing for supporting at least one sheet of print media. A guide device couples the media support with the housing. The guide device defines a guide path having a proximal end and a distal end. The media support is configured to move along the guide path. The media support is moved in a direction from the proximal end toward the distal end when the media support is moved from a stowed position to an extended position. A pivot mechanism is located near the distal end of the guide path to facilitate a pivoting of the media support so as to be inclined in relation to the guide path when the media support is pivoted from the extended position to an operating position.

20 Claims, 6 Drawing Sheets

MEDIA SUPPORT FOR AN IMAGING APPARATUS

BACKGROUND OF THE INVENTION

1. Field of the Invention.

The present invention relates to an imaging apparatus, and, more particularly, to a retractable media support for an imaging apparatus.

2. Description of the Related Art.

An imaging apparatus may be in the form of a printer, or a multifunction machine, also known as an all-in-one (AIO) machine, which includes scanning and copying capabilities in addition to printing.

The print engine of the printer or the AIO may include, for example, an ink jet print engine that typically forms an image on a sheet of print media by ejecting ink from at least one ink jet printhead to place ink dots on the sheet of print media. Such an ink jet print engine typically includes a reciprocating printhead carrier. Mounted to the carrier is one or more printhead cartridges, each including an ink supply and at least one printhead. The carrier transports the ink jet printheads across the sheet of print media along a bi-directional scanning path defining a print zone of the print engine. The bi-directional scanning path is oriented parallel to a main scan direction, also commonly referred to as the horizontal direction.

Typically, a sheet of print media is picked from a stack of print media supported in a media tray, and transported by a feed roller to the print zone for printing. An indexing mechanism drives the feed roller to incrementally advance the sheet of print media in a sheet feed direction, also commonly referred to as a sub-scan direction, through the print zone between scans in the main scan direction, or after all data intended to be printed on the sheet of print media at a particular stationary position has been completed.

The current trend in the imaging industry, as a whole, is to reduce the overall size of the imaging apparatus, while including as many features as reasonably possible.

SUMMARY OF THE INVENTION

The present invention provides a retractable media support for an imaging apparatus.

The invention, in one form thereof, is directed to an imaging apparatus. The imaging apparatus includes a housing, and a media support mounted to the housing for supporting at least one sheet of print media. A guide device couples the media support with the housing. The guide device defines a guide path having a proximal end and a distal end. The media support is configured to move along the guide path. The media support is moved in a direction from the proximal end toward the distal end when the media support is moved from a stowed position to an extended position. A pivot mechanism is located near the distal end of the guide path to facilitate a pivoting of the media support so as to be inclined in relation to the guide path when the media support is pivoted from the extended position to an operating position.

The invention, in another form thereof, is directed to an imaging apparatus. The imaging apparatus includes a print engine, and a housing for mounting the print engine. A first slot and a second slot are formed in the housing. The second slot is parallel to the first slot and spaced apart from the first slot. Each of the first slot and the second slot has a proximal end and a distal end. The first slot is defined by a first surface having a first linear extent as measured from the proximal end toward the distal end and a second surface having a second linear extent greater than the first linear extent as measured from the proximal end toward the distal end. The first surface faces the second surface. A ledge is positioned between the first slot and the second slot at a distance from the proximal end of equal to or greater than the first linear extent from the proximal end. A media support plate has a first slide member, and a second slide member spaced apart from the first slide member. The media support plate has a stowed position and an operating position. The first slide member is slidably received in the first slot and the second slide member is slidably received in the second slot when the media support is in the stowed position. The media support plate is supported by the ledge and by an end of the second surface at an incline with respect to the first slot and the second slot when the media support is positioned in the operating position.

The invention, in another form thereof, is directed to a method for providing a media support for an imaging apparatus, including moving a media support unit along a linear guide path from a stowed position to an extended position; and pivoting the media support so as to be inclined in relation to the linear guide path when the media support is moved from the extended position to an operating position.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
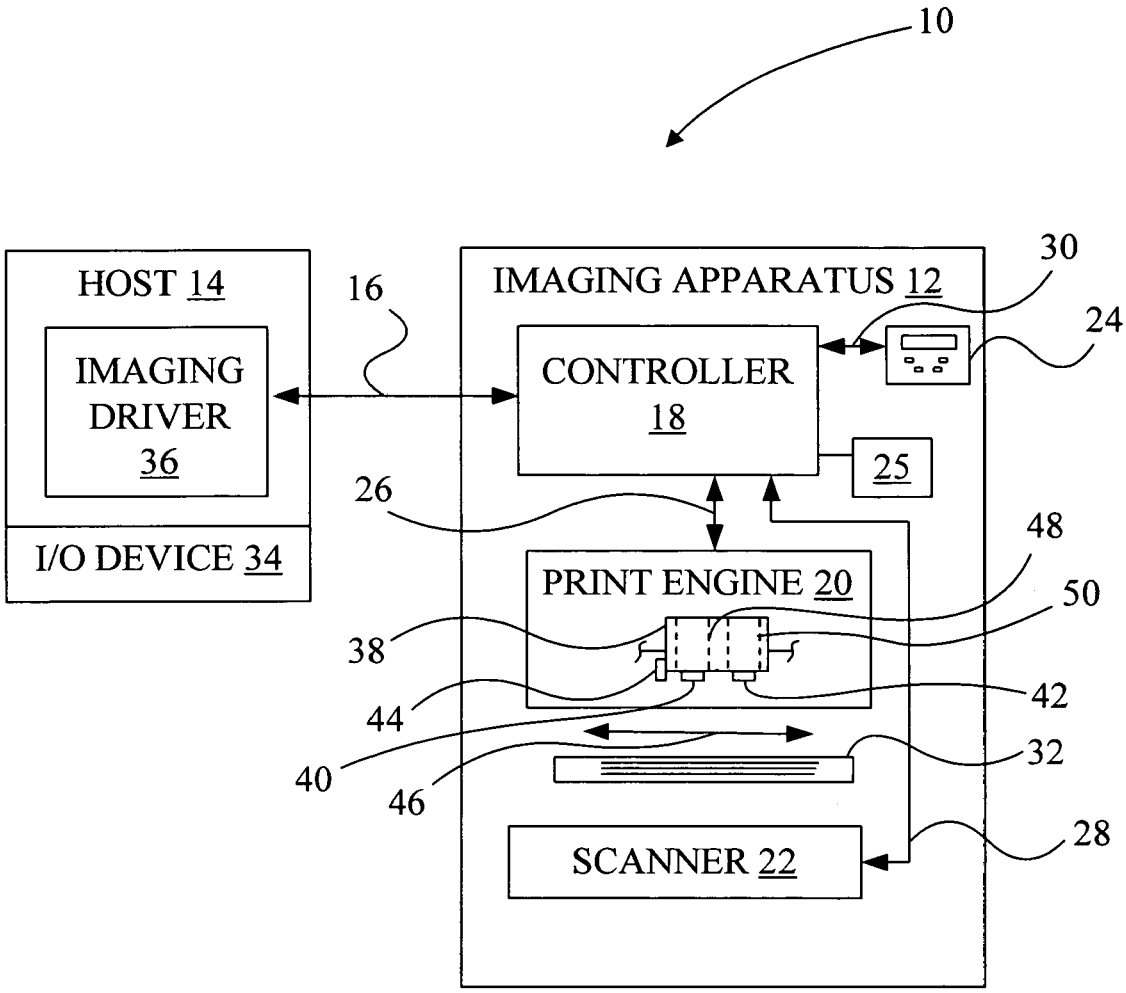
FIG. 1 is a diagrammatic depiction of a system embodying the present invention.

Referring now to the drawings and particularly to FIG. 1, there is shown a diagrammatic depiction of an imaging system 10. Imaging system 10 may include an imaging apparatus 12 and a host 14, with imaging apparatus 12 communicating with host 14 via a communications link 16.

Imaging apparatus 12 may be configured to communicate with host 14 via a standard communication protocol, such as for example, universal serial bus (USB) or Ethernet. As used herein, the term "communications link" is used to generally refer to structure that facilitates electronic communication between two components, and may operate using wired or wireless technology. Communications link 16 may be established, for example, by a direct cable connection, wireless connection or by a network connection such as for example an Ethernet local area network (LAN).

Alternatively, imaging apparatus 12 may be a standalone unit that is not communicatively linked to a host, such as host 14. For example, imaging apparatus 12 may take the form of a multifunction machine, e.g., an all-in-one (AIO) device, which includes standalone copying and facsimile capabilities, in addition to optionally serving as a printer when attached to a host, such as host 14. Imaging apparatus 12 includes, for example, a controller 18, a print engine 20, a scanner 22 and a user interface 24.

Controller 18 includes a processor unit and associated memory, such as memory 25, and may be formed as an Application Specific Integrated Circuit (ASIC). Controller 18 communicates with print engine 20 via a communications link 26. Controller 18 communicates with scanner 22 via a communications link 28. Controller 18 communicates with user interface 24 via a communications link 30. Communications links 26, 28 and 30 may be established, for example, by using standard electrical cabling or bus structures, or by wireless connection.

In the context of the examples for imaging apparatus 12 given above, print engine 20 may be, for example, an ink jet print engine configured for forming an image on a sheet of print media 32, such as a sheet of paper, transparency or fabric. As an ink jet print engine, for example, print engine 20 operates one or more printing cartridges and/or printheads to eject ink droplets onto the sheet of print media 32 in order to reproduce text and/or images.

Host 14 may be, for example, a personal computer including an input/output (I/O) device 34, such as a keyboard and display monitor. Host 14 further includes a processor, input/output (I/O) interfaces, memory, such as RAM, ROM, NVRAM, and a mass data storage device, such as a hard drive, CD-ROM and/or DVD units. During operation, host 14 includes in its memory a software program including program instructions that function as an imaging driver 36, e.g., printer driver software for imaging apparatus 12. Imaging driver 36 is in communication with controller 18 of imaging apparatus 12 via communications link 16. Imaging driver 36 facilitates communication between imaging apparatus 12 and host 14, and may provide formatted print data to imaging apparatus 12, and more particularly, to print engine 20.

Alternatively, however, all or a portion of imaging driver 36 may be located in controller 18 of imaging apparatus 12. For example, where imaging apparatus 12 is a multifunction machine having standalone capabilities, controller 18 of imaging apparatus 12 may include an imaging driver configured to support a scanning and/or copying function using scanner 22, and/or a fax-print function, and may be further configured to support a printer function. Scanner 22 may be, for example, a bed type scanner with a movable scan bar, or a scanner that transports paper under a stationary scan bar. In one embodiment, for example, the imaging driver facilitates communication of formatted print data, as determined by a selected print mode, to print engine 20, and facilitates communication of scanned image data to controller 18.

Print engine 20 may include, for example, a reciprocating printhead carrier 38, a color ink jet printhead 40, a monochrome ink jet printhead 42 and (optionally) a reflectance sensor 44. Controller 18 serves to process print data and to operate print engine 20 during printing, as well as to operate scanner 22, process image data obtained via scanner 22, and process printhead alignment data obtained by scanner 22 or reflectance sensor 44. In order for print data from host 14 to be properly printed by print engine 20, the RGB data generated by host 14 is converted into data compatible with print engine 20 and ink jet printheads 40, 42. Likewise, in order for scanner data from scanner 22 to be properly printed by print engine 20, the RGB data generated by scanner 22 is converted into data compatible with print engine 20 and ink jet printheads 40, 42.

Printhead carrier 38 transports ink jet printheads 40, 42 and reflectance sensor 44 in a reciprocation manner along a bidirectional main scan axis 46 over an image surface of the sheet of print media 32 during printing and/or sensing operations. Printhead carrier 38 may be mechanically and electrically configured to mount, carry and facilitate one or more of each of a color printhead cartridge 48 and a monochrome printhead cartridge 50. Each color printhead cartridge 48 may include, for example, an ink reservoir containing a supply of ink, to which at least one respective color ink jet printhead 40 is attached. Each monochrome printhead cartridge 50 may include, for example, an ink reservoir containing a supply of ink, to which at least one respective monochrome ink jet printhead 42 is attached. Alternatively, monochrome ink jet printhead 42 may be replaced by another color printhead, such as a photo printhead for jetting diluted color and mono inks.

Figure 2:
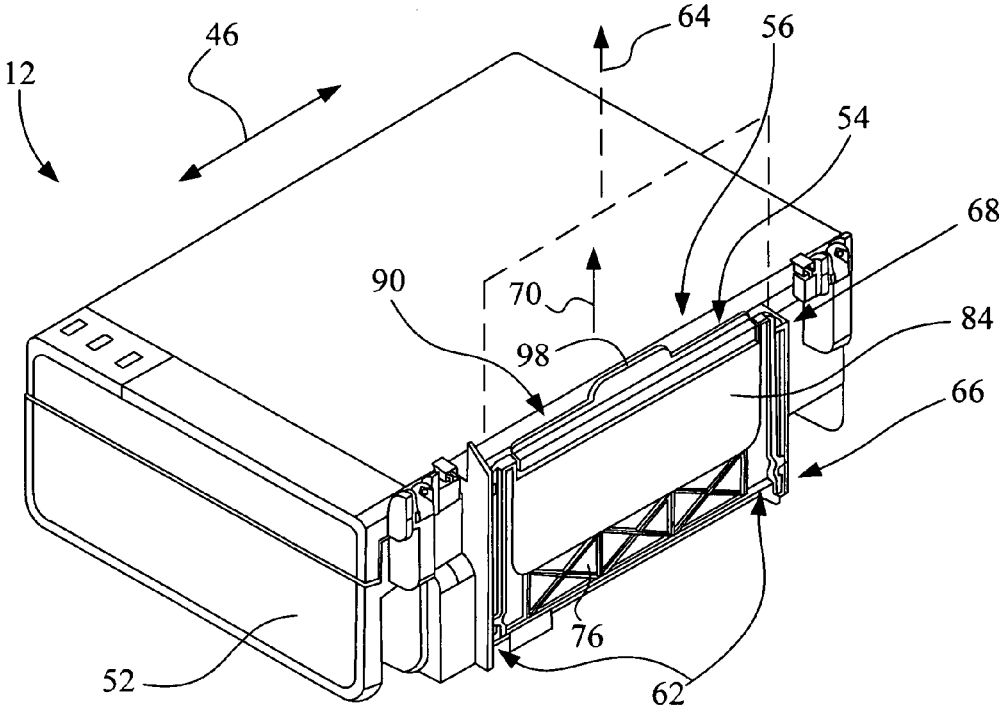
FIG. 2 is a perspective view of the imaging apparatus of FIG. 1, including a housing and a media support, with the media support in a stowed position.
Figure 3:
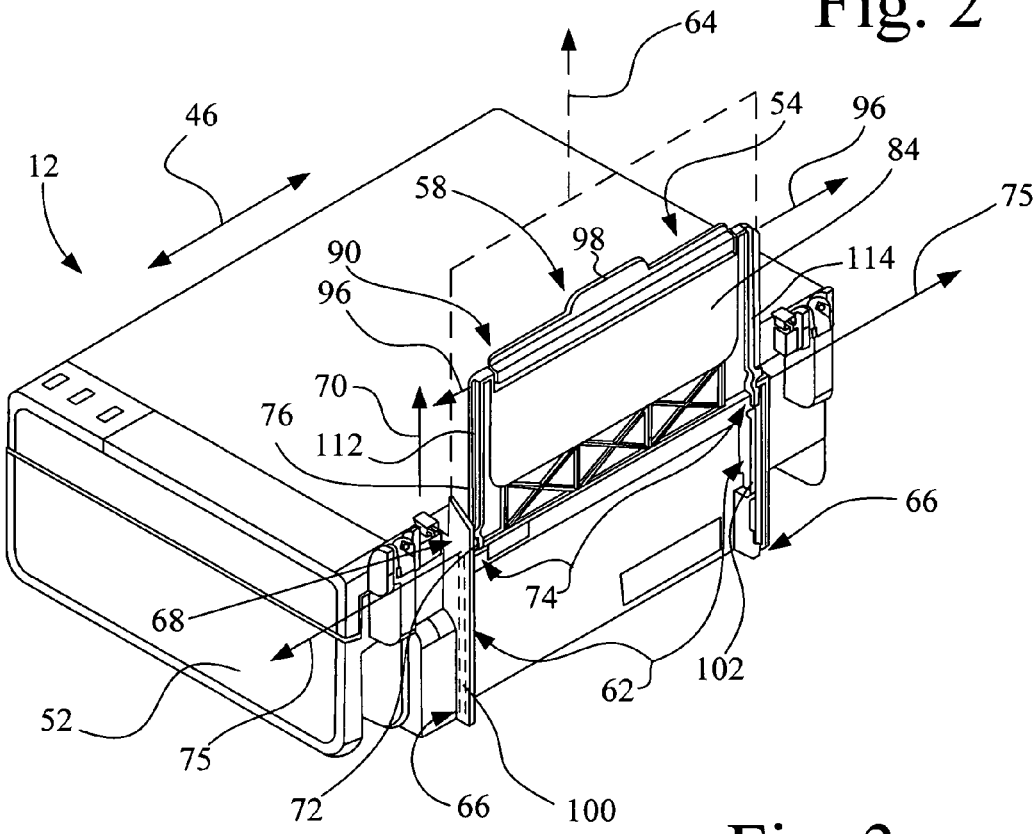
FIG. 3 is a perspective view of the imaging apparatus of FIG. 1, including the housing and the media support of FIG. 2, with the media support in an extended position.
Figure 4:
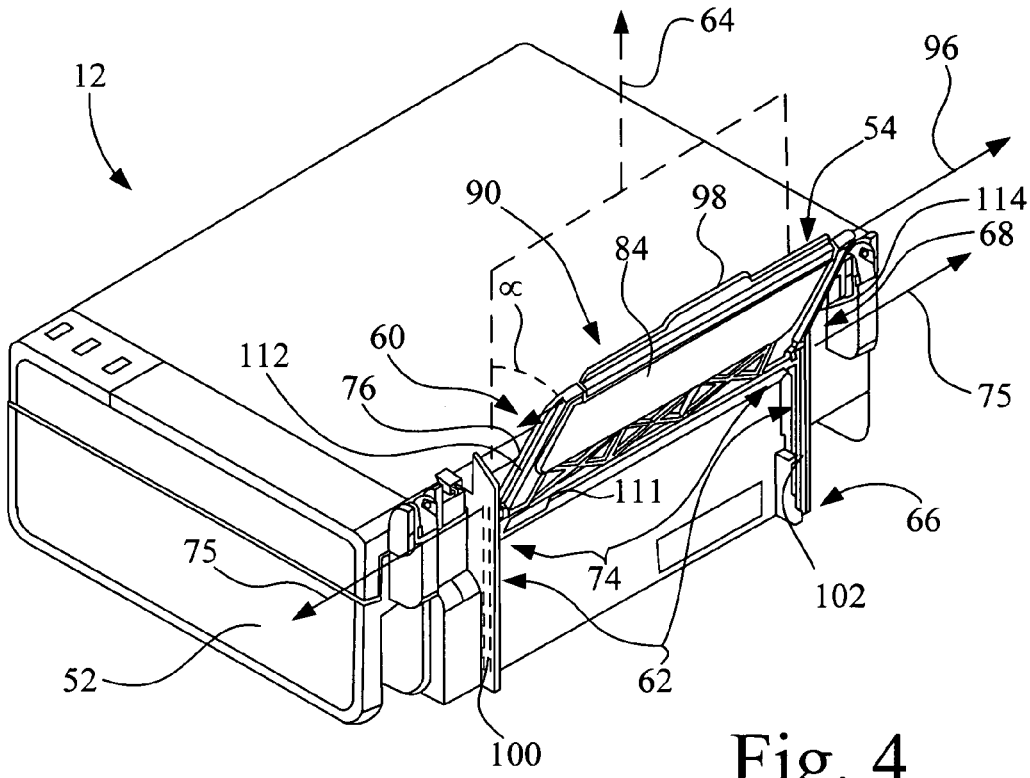
FIG. 4 is a perspective view of the imaging apparatus of FIG. 1, including the housing and the media support of FIGS. 2 and 3, with the media support in an operating position.

Referring now to FIGS. 2-5, imaging apparatus 12 includes a housing 52 and a media support 54. In the embodiment shown, housing 52 mounts and contains print engine 20, scanner 22 and user interface 24. Media support 54 is mounted to housing 52 for supporting at least one sheet of print media 32 to be fed to print engine 20 during a printing operation. Accordingly, media support 54 functions as a media supply source for imaging apparatus 12. FIG. 2 shows media support 54 in a stowed position 56. While media support 54 is in stowed position 56, housing 52 provides protection for media support 54, such as for example, during shipment or when not in use. FIG. 3 shows media support 54 in an extended position 58. FIGS. 4 and S show media support 54 in an operating position 60.

A guide device 62 couples media support 54 with housing 52. Guide device 62 defines a linear, e.g., substantially vertical, guide path 64 having a proximal end 66 and a distal end 68. Media support 54 is configured to move along linear guide path 64. Media support 54 is moved in a direction 70 from proximal end 66 toward distal end 68 when media support 54 is moved from stowed position 56 to an extended position 58. A stop member 72 is positioned to stop a linear translation of media support 54 along linear guide path 64 when media support 54 is moved to extended position 58.

Referring to FIGS. 3 and 4, a pivot mechanism 74 is located near distal end 68 of linear guide path 64 to facilitate a pivoting of media support 54 generally around a pivot axis 75 so as to be inclined in relation to linear guide path 64 when media support 54 is pivoted from extended position 58 shown in FIG. 3 to operating position 60. Pivot mechanism 74 may include, for example, an opening at distal end 68 which in conjunction with the configuration of media support 54 allows media support 54 to move outside the plane of linear guide path 64. An angle $\alpha$ of the incline may be about 15 degrees from vertical, i.e., about 15 degrees from the vertical extent of linear guide path 64.

Figure 5:
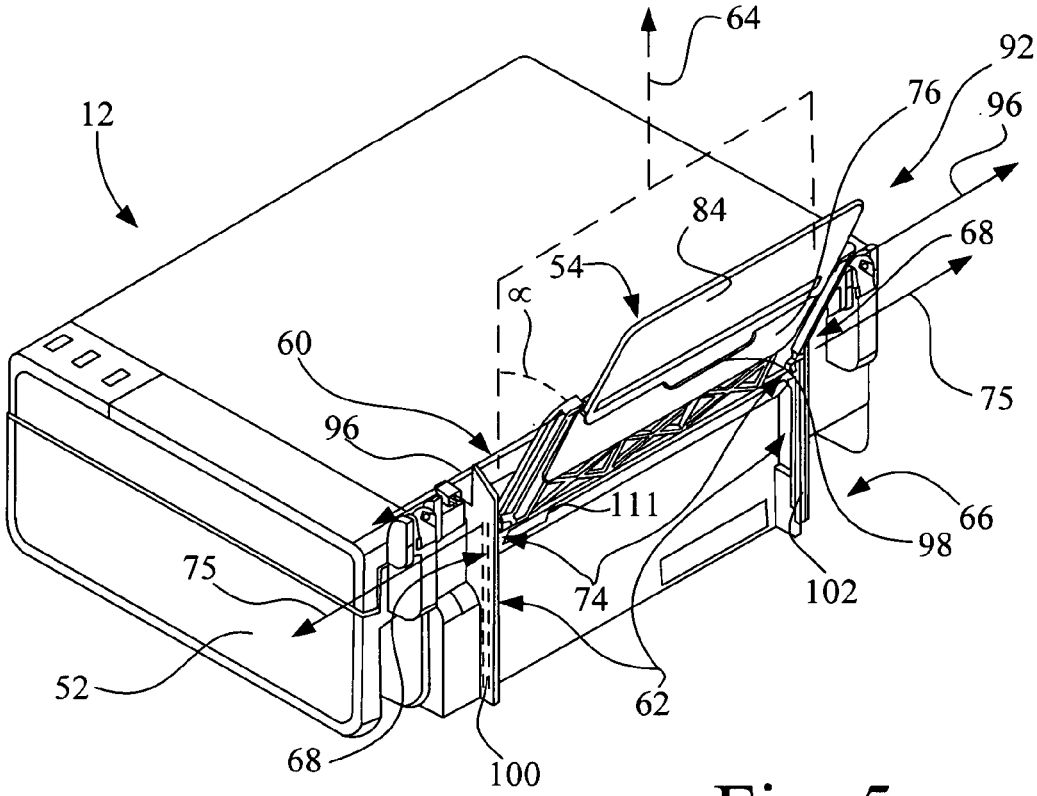
FIG. 5 is a perspective view of the imaging apparatus of FIG. 1, including the housing and the media support of FIGS. 2, 3 and 4, with the media support in the operating position and with an extension member positioned in an extension position.
Figure 6:
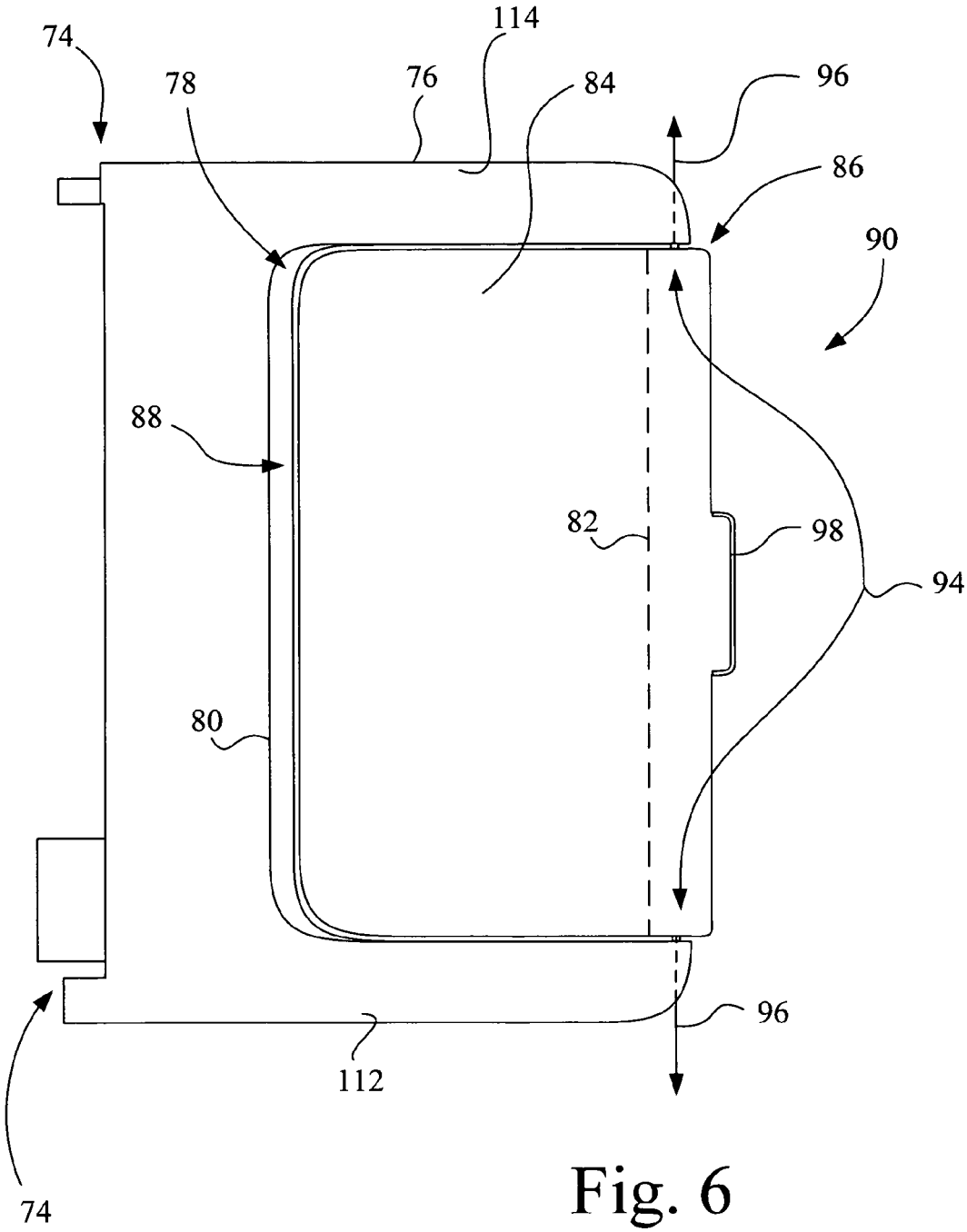
FIG. 6 is a top view of the media support of FIGS. 2-5.

As best seen in FIG. 6, media support 54 includes a media support plate 76 having a recessed region 78 with a proximal edge 80 and a distal edge 82. Media support 54 further includes an extension member 84 having a first end 86 and a second end 88. Extension member 84 is sized to fit in recessed region 78 of media support plate 76. Extension member 84 is configured to be movable from a stored position 90, shown in FIGS. 4 and 6, wherein extension member 84 is positioned in recessed region 78 of media support plate 76, to an extension position 92, shown in FIG. 5, wherein extension member 84 is positioned to extend a length of media support plate 76.

As best seen in FIG. 6, a pivot coupling 94, e.g., a pair of pins and corresponding sockets, attaches first end 86 of extension member 84 to media support plate 76 along a pivot axis 96 located near, e.g., within 0 to 2 centimeters of, distal edge 82 of recessed region 78.

Extension member 84 is configured with a tab 98 extending from first end 86 of extension member 84. Tab 98 is oriented to be exposed for grasping by a user when extension member 84 is in stored position 90. Tab 98 is oriented to engage media support plate 76 when extension member 84 is pivoted about 180 degrees around pivot axis 96 to stop the pivoting of extension member 84 with respect to media support plate 76.

Referring again to FIGS. 2 and 3, linear guide path 64 may be defined by a parallel of opposing linear slots 100, 102 formed in housing 52. Linear slots 100, 102 are horizontally spaced, i.e., spaced in a direction parallel to bi-directional main scan axis 46. The configuration of slots 100 and 102 may be substantially the same, with one being the mirror image of the other. Accordingly, only the configuration of slot 100 will be described in detail below, although the description of slot 100 may be applied to slot 102.

Figure 7:
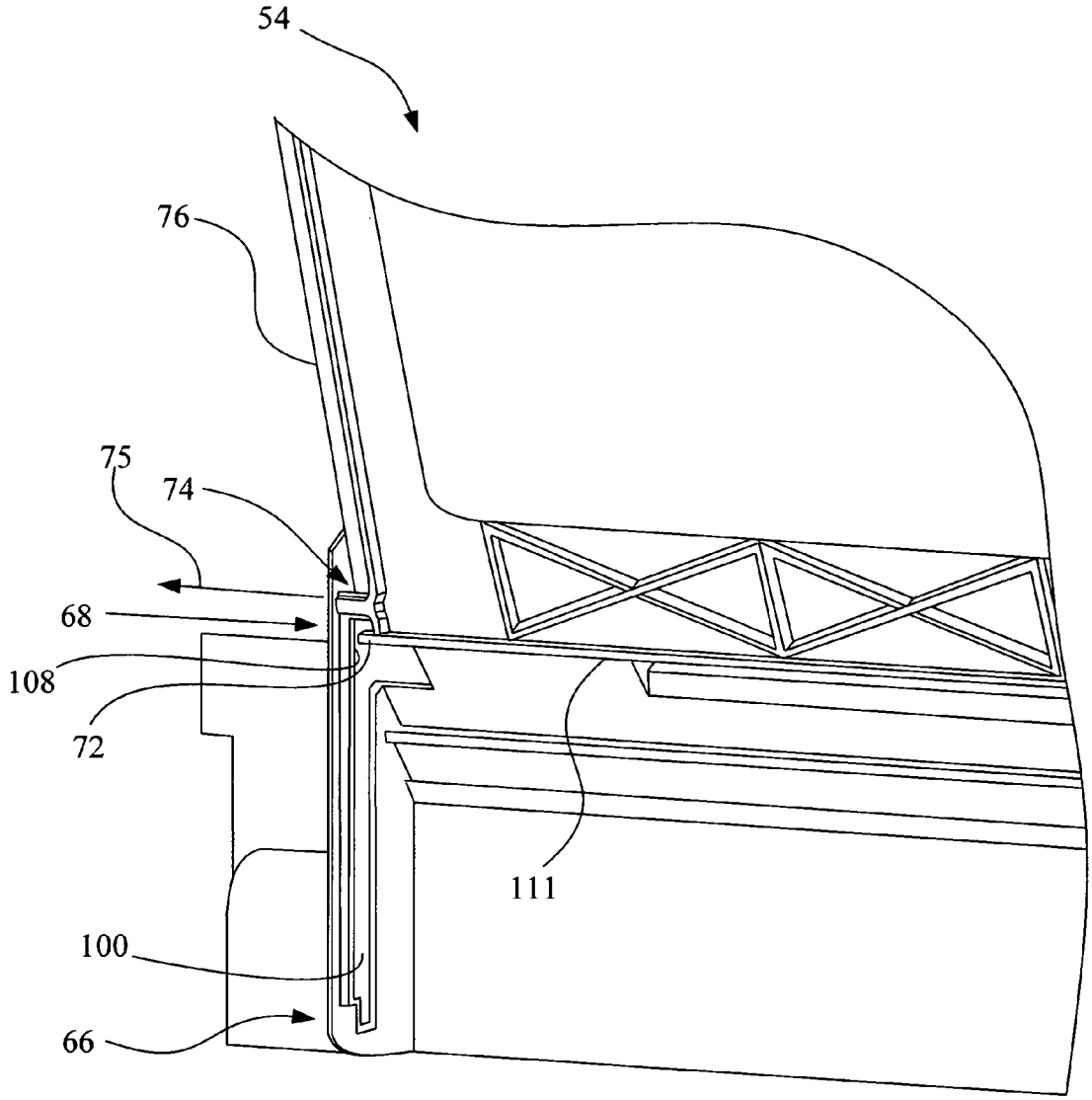
FIG. 7 is a broken-out portion of the imaging apparatus of FIGS. 2-5, showing in a perspective view one of the slots that define the linear guide path of the media support for the imaging apparatus.
Figure 8:
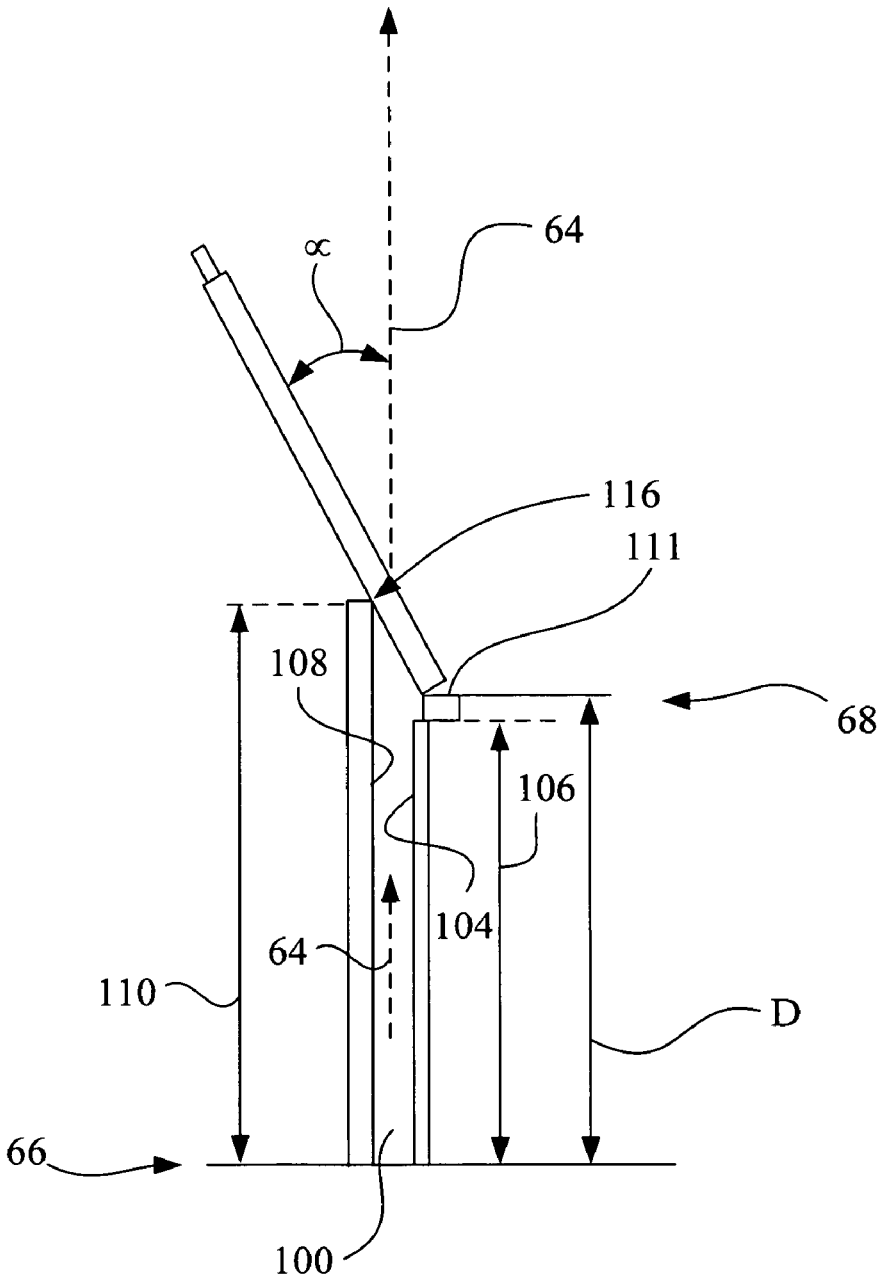
FIG. 8 is a diagrammatic side view of the broken-out portion of FIG. 7.

Referring to FIGS. 7 and 8, slot 100 is formed in housing 52 having proximal end 66 and distal end 68. Slot 100 is defined by a first surface 104 having a first linear extent 106 as measured from proximal end 66 toward distal end 68 and a second surface 108 with a second linear extent 110 greater than first linear extent 106 as measured from proximal end 66 toward distal end 68. First surface 104 is oriented to face second surface 108. In one embodiment, surfaces 104 and 108 may be in the form of a pair of walls. A ledge 111 is positioned between slot 100 and slot 102 (see also, FIGS. 4 and 5) at a distance D from proximal end 66 that is equal to or greater than (≧) the first linear extent 106 from proximal end 66.

Referring also to FIGS. 3 and 6, media support plate 76 has a first slide member 112, and a second slide member 114 spaced apart from first slide member 112. First slide member 112 is slidably received in slot 100 and second slide member 114 is slidably received in slot 102 when media support 54 is in stowed position 56. Thus, media support plate 76 is guided along linear guide path 64 defined by slot 100 and slot 102 when media support 54 is translated from stowed position 56 shown in FIG. 2 to extended position 58 as shown in FIG. 3, which is intermediate of stowed position 56 shown in FIG. 2 and operating position 60 shown in FIG. 4. Stop member 72 is positioned to stop the linear translation of media support 54 when media support 54 is moved to extended position 58. First slide member 112 and second slide member 114 of media support plate 76 exit slot 100 and slot 102, respectively, when media support 54 is in operating position 60.

As best seen in FIGS. 7 and 8, with further reference to FIGS. 4 and 5, media support plate 76 is supported by ledge 111 and by an end 116 of second surface 108 at the angle of incline α with respect to slot 100 and slot 102 when media support 54 is positioned in operating position 60. Pivot mechanism 74 is located near distal end 68 of slot 100 to facilitate a pivoting of media support plate 76 so as to be inclined in relation to linear guide path 64 when media support plate 76 is pivoted from extended position 58 shown in FIG. 3 to operating position 60 shown in FIGS. 4 and 5.

During operation of media support 54, media support 54 is moved as a unit along linear guide path 64 from stowed position 56 to extended position 58. Media support 54 then is moved from extended position 58 to operating position 60 by pivoting media support 54 around pivot axis 75, so that media support 54 is inclined at angle α in relation to linear guide path 64. Next, extension member 84 of media support 54 is pivoted around pivot axis 96 with respect to media support plate 76, e.g., the base portion, of media support 54 to extend a length of media support plate 76.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a housing;

a media support mounted to said housing for supporting at least one sheet of print media;

a guide device coupling said media support with said housing, said guide device defining a guide path having a proximal end and a distal end, said media support being configured to move along said guide path, said media support being moved in a direction from said proximal end toward said distal end when said media support is moved from a stowed position to an extended position; and a pivot mechanism located near said distal end of said guide path to facilitate a pivoting of said media support only after said media support has been moved along said guide path, so as to be inclined in relation to said guide path when said media support is pivoted from said extended position to an operating position.

2. The imaging apparatus of claim 1, wherein said guide path is a linear guide path.

3. The imaging apparatus of claim 2, wherein said linear guide path is oriented to be substantially vertical.

4. The imaging apparatus of claim 2, further comprising a stop member positioned to stop a linear translation of said media support along said linear guide path when said media support is moved to said extended position.

5. The imaging apparatus of claim 1, said media support including:

a media support plate having a recessed region with a proximal edge and a distal edge; and an extension member having a first end and a second end, said extension member being sized to fit in said recessed region of said media support plate, said extension member being configured to be movable from a stored position, wherein said extension member is positioned in said recessed region of said media support plate, to an extension position wherein said extension member is positioned to extend a length of said media support plate.

6. The imaging apparatus of claim 5, further comprising a pivot coupling that attaches said first end of said extension member to said media support plate along a pivot axis located near said distal edge of said recessed region.

7. The imaging apparatus of claim 1, wherein said guide path is defined by a pair of parallel of linear slots formed in said housing, said pair of parallel linear slots being horizontally spaced.

8. An imaging apparatus, comprising:

a housing;

a media support mounted to said housing for supporting at least one sheet of print media, said media support including a media support plate having a recessed region with a proximal edge and a distal edge, and an extension member having a first end and a second end, said extension member being sized to fit in said recessed region of said media support plate, said extension member being configured to be movable from a stored position, wherein said extension member is positioned in said recessed region of said media support plate, to an extension position wherein said extension member is positioned to extend a length of said media support plate;

a guide device coupling said media support with said housing, said guide device defining a guide path having a proximal end and a distal end, said media support being configured to move along said guide path, said media support being moved in a direction from said proximal end toward said distal end when said media support is moved from a stowed position to an extended position; and a pivot mechanism located near said distal end of said guide path to facilitate a pivoting of said media support so as to be inclined in relation to said guide path when said media support is pivoted from said extended position to an operating position, wherein said extension member is configured with a tab extending from said first end of said extension member, said tab being oriented to be exposed for grasping by a user when said extension member is in said stored position.

9. The imaging apparatus of claim 8, wherein said tab is oriented to engage said media support plate when said extension member is pivoted about 180 degrees around a pivot axis located near said distal edge of said recessed region to stop a pivoting of said extension member with respect to said media support plate.

10. An imaging apparatus, comprising:

a print engine;

a housing for mounting said print engine;

a first slot and a second slot, each formed in said housing, said second slot being parallel to said first slot and spaced apart from said first slot, each of said first slot and said second slot having a proximal end and a distal end, said first slot being defined by a first surface having a first linear extent as measured from said proximal end toward said distal end and a second surface having a second linear extent greater than said first linear extent as measured from said proximal end toward said distal end, said first surface facing said second surface;

a ledge positioned between said first slot and said second slot at a distance from said proximal end of equal to or greater than said first linear extent from said proximal end;

a media support plate having a first slide member, and a second slide member spaced apart from said first slide member, said media support plate having a stowed position and an operating position, said first slide member being slidably received in said first slot and said second slide member being slidably received in said second slot when said media support is in said stowed position, and said media support plate being supported by said ledge and by an end of said second surface at an incline with respect to said first slot and said second slot when said media support is positioned in said operating position.

11. The imaging apparatus of claim 10, wherein said media support plate is guided along a linear guide path defined by said first slot and said second slot when said media support is translated from said stowed position to an extended position intermediate of said stowed position and said operating position.

12. The imaging apparatus of claim 11, further comprising a stop member positioned to stop a linear translation of said media support when said media support is moved to said extended position.

13. The imaging apparatus of claim 12, comprising a pivot mechanism located near said distal end of said first slot to facilitate a pivoting of said media support plate so as to be inclined in relation to said linear guide path when said media support plate is pivoted from said extended position to said operating position.

14. The imaging apparatus of claim 10, wherein said first slide member and said second slide member of said media support plate exit said first slot and said second slot, respectively, when said media support is in said operating position.

15. The imaging apparatus of claim 10, wherein said media support plate includes a recessed region having a proximal edge and a distal edge, said imaging apparatus further comprising an extension member having a first end and a second end, said extension member being sized to fit in said recessed region of said media support plate, said extension member configured to be movable from a stored position wherein said extension member is positioned in said recessed region of said media support plate, to an extension position wherein said extension member is positioned to extend a length of said media support plate.

16. The imaging apparatus of claim 15, further comprising a pivot coupling that attaches a first end of said extension member to said media support plate along a pivot axis located near said distal edge of said recessed region.

17. The imaging apparatus of claim 15, wherein said extension member is configured with a tab extending from said first end of said extension member, said tab being oriented to be exposed for grasping by a user when said extension member is in said stored position.

18. The imaging apparatus of claim 17, wherein said tab is oriented to engage said media support plate when said extension member is pivoted about 180 degrees around a pivot axis located near said distal edge of said recessed region to stop a pivoting of said extension member with respect to said media support plate.

19. A method for providing a media support for an imaging apparatus with a guide device coupling said media support with said housing, said guide device defining a guide path having a proximal end and a distal end, said media support being configured to move along said guide path, said media support being moved in a direction from said proximal end toward said distal end when said media support is moved from a stowed position to an extended position, comprising:

moving a media support mounted to a housing for supporting at least one sheet of print media along a linear guide path from a stowed position to an extended position; and pivoting said media support only after said media support has been moved along said guide path when the media support reaches a pivot mechanism located near said distal end of said guide path to facilitate a pivoting of said media support so as to be inclined in relation to said linear guide path when said media support is moved from said extended position to an operating position.

20. The method of claim 19, further comprising pivoting an extension member of said media support with respect to a media support plate of said media support to extend a length of said media support plate.

* * * * *